US009579553B2

(12) United States Patent
Rehkemper et al.

(10) Patent No.: US 9,579,553 B2
(45) Date of Patent: Feb. 28, 2017

(54) METHOD AND APPARATUS FOR LAUNCH AND CATCH DEVICE

(71) Applicant: Rehco, LLC, Chicago, IL (US)

(72) Inventors: Steven Rehkemper, Chicago, IL (US); John L. Peach, East Aurora, NY (US); Jeremy Posner, Chicago, IL (US)

(73) Assignee: Rehco, LLC, Chicago, IL (US)

( * ) Notice: Subject to any disclaimer, the term of this patent is extended or adjusted under 35 U.S.C. 154(b) by 0 days.

(21) Appl. No.: 14/633,682

(22) Filed: Feb. 27, 2015

(65) Prior Publication Data

US 2015/0238850 A1 Aug. 27, 2015

Related U.S. Application Data

(60) Provisional application No. 61/945,458, filed on Feb. 27, 2014.

(51) Int. Cl.

| | |
|---|---|
| ***A63B 67/08*** | (2006.01) |
| ***A63F 9/02*** | (2006.01) |
| ***F41B 4/00*** | (2006.01) |
| ***A63B 65/12*** | (2006.01) |
| *A63F 9/00* | (2006.01) |
| *A63F 9/24* | (2006.01) |
| *A63B 69/40* | (2006.01) |

(52) U.S. Cl.

CPC ..... *A63B 67/083* (2013.01); *A63B 65/12* (2013.01); *A63F 9/0252* (2013.01); *F41B 4/00* (2013.01); *A63B 69/406* (2013.01); *A63F 2009/0087* (2013.01); *A63F 2009/0265* (2013.01); *A63F 2009/2482* (2013.01); *A63F 2250/38* (2013.01)

(58) Field of Classification Search

CPC ..... A63B 67/083; A63B 69/406; A63B 65/12; F41B 4/00

USPC ..... 124/1, 6, 78; 473/431, 436, 505, 509

See application file for complete search history.

(56) References Cited

U.S. PATENT DOCUMENTS

| | | | | | |
|---|---|---|---|---|---|
| 930,918 | A * | 8/1909 | Barry | A63B 67/083 | 473/509 |
| 1,022,186 | A * | 4/1912 | Engler | A63B 59/20 | 473/509 |
| 1,458,335 | A * | 6/1923 | Glinchikoff | A63B 59/20 | 473/509 |
| 1,972,803 | A * | 9/1934 | Taylor | A63B 59/20 | 473/509 |
| 2,025,995 | A * | 12/1935 | Lerch | A63B 59/20 | 473/509 |
| 2,242,450 | A * | 5/1941 | Carballal | A63B 67/083 | 473/509 |

(Continued)

*Primary Examiner* — Alexander Niconovich

(74) *Attorney, Agent, or Firm* — Brooks Kushman P.C.

(57) ABSTRACT

A device for launching and catching an object is provided. The device may include a body having an inlet, an outlet, and a channel therebetween. A propulsion mechanism may be housed within the body and include a motor. The propulsion mechanism may receive an object traveling at a first speed within the channel and from the inlet and to adjust the speed of the object to a second speed enroute to the outlet such that the object is launched into the air. A receiving funnel defined by the body may catch the object as the object descends such that the object is directed back into the inlet. A method of playing a catch game is also provided which may include one or more devices for launching and catching an object.

11 Claims, 5 Drawing Sheets

(56) References Cited

U.S. PATENT DOCUMENTS 2,505,090 A * 4/1950 Berry ..... A63B 59/20 473/509
2,510,403 A * 6/1950 Krupp ..... A63B 67/083 193/44
3,059,929 A * 10/1962 Licitis ..... A63B 65/12 124/16
3,392,978 A * 7/1968 Wiest, Jr. ..... A63B 67/083 473/509
3,424,461 A * 1/1969 Kirk ..... A63B 59/20 124/5
3,488,056 A * 1/1970 Sramek ..... A63B 67/083 473/509
3,713,658 A * 1/1973 Cook ..... A63B 69/406 124/1
3,844,267 A * 10/1974 Mohr ..... A63B 69/406 124/48
3,992,006 A * 11/1976 Barlow ..... A63B 65/12 124/6
4,045,027 A * 8/1977 Manska ..... A63B 67/083 473/509
4,191,374 A * 3/1980 Kulesza ..... A63B 69/406 124/78
4,249,739 A * 2/1981 Brandell ..... A63B 57/405 273/122 A
4,552,120 A * 11/1985 Nall ..... A63B 69/406 124/1
4,717,155 A * 1/1988 Chu-Hwa ..... A63B 59/20 473/509
4,863,174 A * 9/1989 Cummings ..... A63B 67/083 273/412
5,029,867 A * 7/1991 Johnson ..... A63B 24/0021 473/191
5,123,654 A * 6/1992 Liu ..... A63B 67/083 273/402
5,417,196 A * 5/1995 Morrison ..... A63B 69/40 124/6
6,190,271 B1 * 2/2001 Rappaport ..... A63B 69/0002 124/78
6,241,632 B1 * 6/2001 Obsniuk ..... A63B 67/002 473/505
6,443,859 B1 * 9/2002 Markin ..... A63B 69/406 124/6
6,537,163 B2 * 3/2003 Hicks ..... A63B 67/083 473/509
6,877,501 B2 * 4/2005 Wojtkiewicz ..... F41B 4/00 124/78
6,889,982 B1 * 5/2005 Gove ..... A63B 63/00 273/343
7,207,893 B1 * 4/2007 Louie ..... A63B 63/00 473/166
7,278,934 B2 * 10/2007 McBride ..... A63B 63/00 124/78
7,648,431 B1 * 1/2010 Kinkead ..... A63B 63/00 473/422
9,301,503 B1 * 4/2016 Arrighi ..... A01K 15/025

* cited by examiner 10
12
14
16
18
20
24
25
26
27
32
48

27
32
12
38
20
40
41
14
25
26
24
36

METHOD AND APPARATUS FOR LAUNCH AND CATCH DEVICE

CROSS-REFERENCE TO RELATED APPLICATIONS

This application claims the benefit of U.S. provisional application Ser. No. 61/945,458 filed Feb. 27, 2014, the disclosure of which is hereby incorporated in its entirety by reference herein.

TECHNICAL FIELD

This disclosure relates to a motorized game play device for launching and catching objects.

BACKGROUND

Tossing and catching objects between two or more players may be considered an old and enduring form of play. Due to the popularity of this form of play, there have been many types of tossing toys and games. The activity of tossing and catching multiple objects for a single player is most commonly known as juggling. Improvements in electronics and mechanics continue to improve upon previous tossing toys and games.

SUMMARY

A toy device includes a body, a funnel, and a damper. The body defines an inlet, an outlet, and a channel therebetween. The funnel is secured to the body and open to the inlet. The damper is disposed within the funnel to dampen an impact of an object received therein. The damper may include a sheet of material disposed within the funnel. The sheet of material may define a through hole in at least partial registration with the inlet. The device may also include an actuator assembly with a motorized output gear at least partially disposed within the channel to propel an object through the outlet. The device may include a switch. The actuator assembly may further include a motor operably connected to the output gear, and the switch may trigger activation of the motor at one or more predetermined speeds to adjust a height at which an object reaches relative to the outlet when propelled therethrough. The output gear may define a contact surface along a circumference of the output gear with traction. The device may include a power source supported by the body to power the motor. The channel may be generally arcuate and the outlet may be spaced apart from the actuator assembly a first distance. The inlet may be spaced apart from the actuator assembly a second distance that is less than the first distance.

A launch and catch device includes a body, a funnel, and a flexible member. The body defines an inlet, an outlet, and a channel therebetween. The funnel is secured to the body and defines an inner surface open to the inlet. The flexible member is disposed within the funnel. The device may also include a switch, a motor, and a controller. The controller may be in electrical communication with the switch and the motor such that actuation of the switch activates the motor to operate at a predetermined speed. The device may also include a wheel operably connected to the motor. The wheel may be arranged with the channel to increase a speed of an object traveling from the inlet to the outlet. The flexible member may include ornamental indicia indicative of a target. The flexible member may include a sheet of material at least partially spaced apart from the inner surface and defining a through hole in at least partial registration with the inlet. The flexible member may include a fabric having characteristics which yield to an impact thereon. The body may further define a retaining well sized to at least partially retain an object therein.

A method for playing a catch game includes steps of providing a device having an outlet, an inlet, a channel between the outlet and inlet funnel, and a motorized propulsion device in cooperation with the channel, propelling an object within the channel through the outlet, and tracking a quantity of objects received into the inlet funnel after being propelled from the outlet. The method may also include a step of prompting the propelling following insertion of the object into the inlet funnel. The method may also include a step of propelling the object at a height based on a selected speed of the motor. The method may also include a step of repeatedly propelling the object through the outlet and in response to receipt of the object in the inlet funnel. The method may also include a step of providing a second device having an outlet, an inlet having a damper, a channel providing a path between the outlet and inlet funnel, and a motorized wheel at least partially disposed within the channel, and exchanging between two devices in which the objects are propelled and caught between the device and second device.

A launch and catch device includes a body, a funnel, a sheet of material, a motor, and a wheel. The body defines an inlet, an outlet, and a channel therebetween. The funnel is secured to the body and defines an inner surface and open to the inlet. The sheet of material is disposed within the funnel, at least partially spaced apart from the inner surface, and defines a through hole open to the inlet. The motor secured to the body. The wheel is operably connected to the motor and arranged with the channel to propel an object through the outlet.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ embodiments of the present disclosure. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular embodiments, applications, or implementations.

Tossing and catching objects between two or more players may be considered an old and enduring form of play. Due to the popularity of this form of play, there have been many types of tossing toys and games. The activity of tossing and catching multiple objects for a single player is most commonly known as juggling. When manually tossing an object that must also be caught by the same player, skill may be needed to execute a controlled and accurate toss. To further enhance the experience of single player toss and catch toys with one or more objects, the play may be further enhanced, simplified, and modified by the use of a motorized launching device thereby allowing the player to focus on catching the object.

Figures 1, 2, 3:
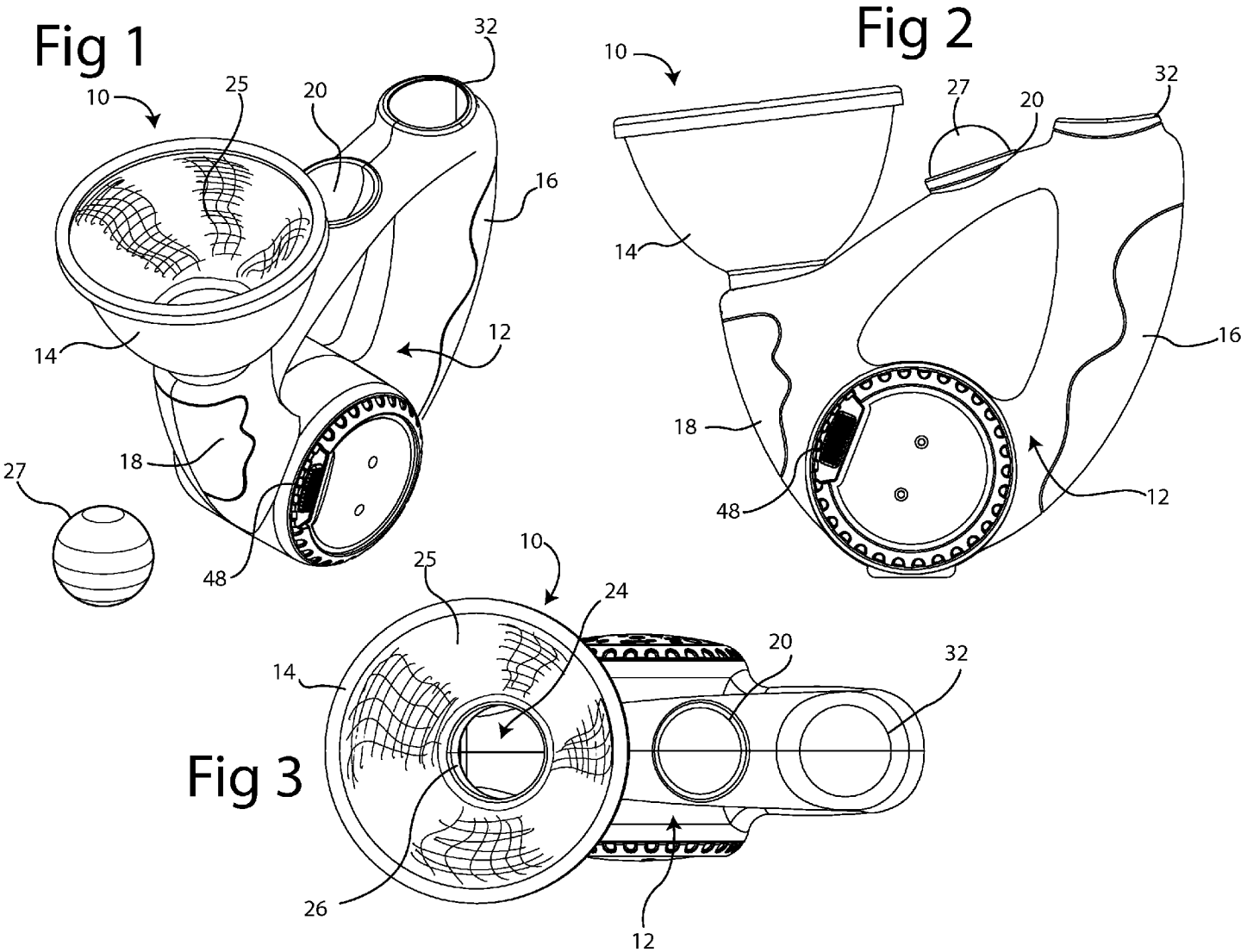
FIG. 1 is perspective view of a device according to one embodiment.
FIG. 2 is a side view of the device from FIG. 1.
FIG. 3 is a top view of the device from FIG. 1.

FIGS. 1 through 3 show an illustrative launch and catch device 10. The device 10 may include a body 12 which may define a receiving funnel 14, a first handle 16, a second handle 18, and a retaining well 20. It is contemplated that the body 12 may have alternative styling, the exemplary images shown are for illustrative purposes only. The receiving funnel 14 may be formed with the body 12 or may be formed separately and secured thereto. The receiving funnel 14 may define an inner surface which may converge at an inlet 24. A sheet of material may be secured within the receiving funnel 14. For example, a piece of fabric or cloth 25 may be secured to an upper portion of the receiving funnel 14. The cloth 25 may have a soft texture, be disposed within the receiving funnel 14, and may define a through-hole portion 26 arranged adjacent to the inlet 24.

The cloth 25 and receiving funnel 14 may be arranged with one another and define a space therebetween such that the cloth 25 may dampen the impact of an object to assist in directing the object to travel toward the through-hole portion 26 and the inlet 24. One example of an object for use with the device 10 may include a ball 27. It is contemplated that the ball 27 may be formed of different materials, such as foam or other suitable materials. As further described herein, more than one ball 27 may be used with the device to facilitate multiple launch and catch play patterns.

The first handle 16 and the second handle 18 may provide a location on the body 12 in which a user may grasp and/or hold the device 10. While the first handle 16 and the second handle 18 are shown on either side of the device 10, it is contemplated that other locations are available to provide for grasping and/or holding the device 10. The retaining well 20 may be defined by the body 12 and may provide a location to hold the ball 27 and as such may be sized appropriately.

Figures 4A, 4B, 4C:
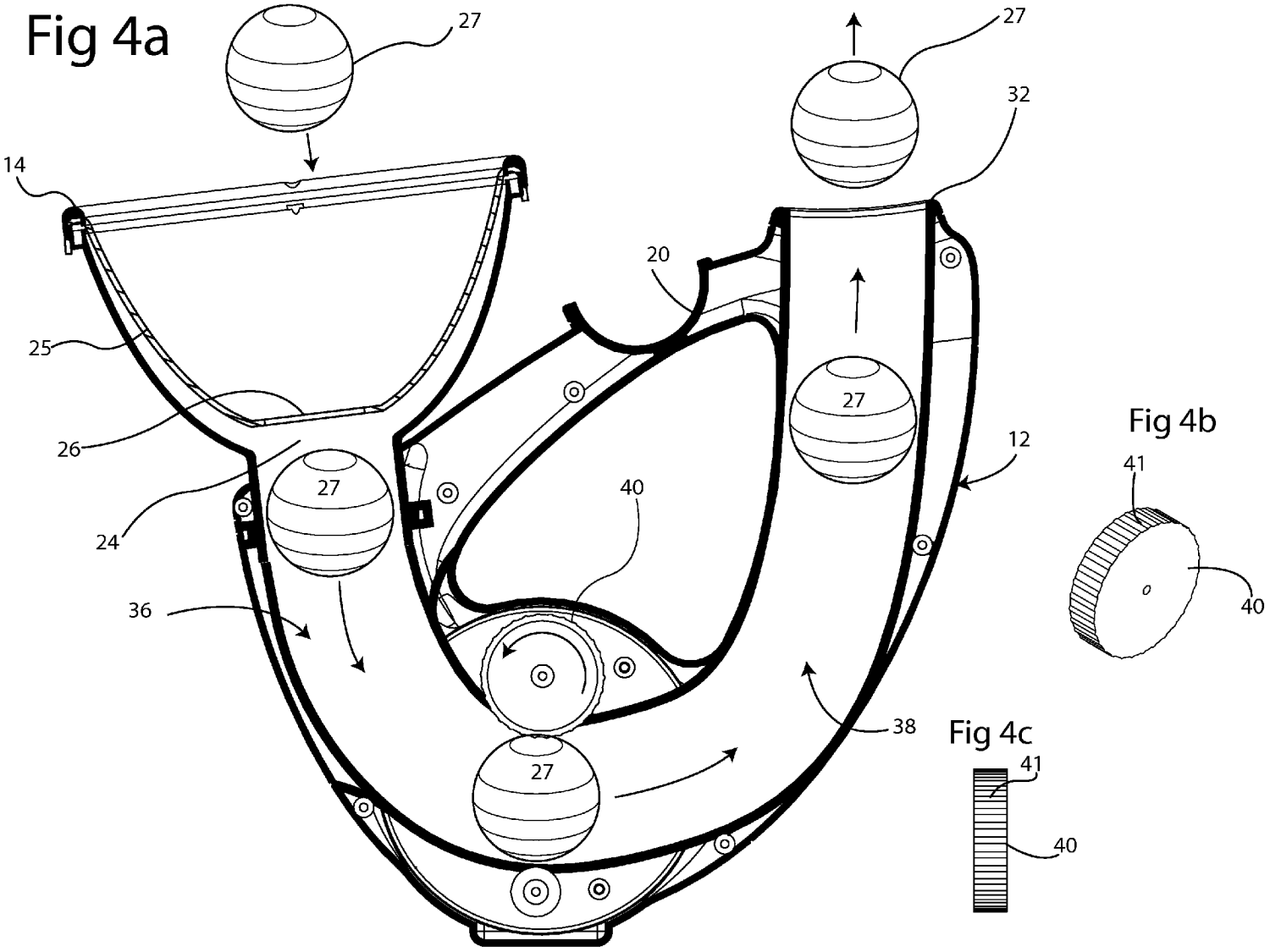
FIG. 4*a* is side view, in cross-section, of the device from FIG. 1.
FIG. 4*b* is a perspective view of a wheel of the device from FIG. 1.
FIG. 4*c* is a front view of the wheel from FIG. 4*b*.
Figure 5:
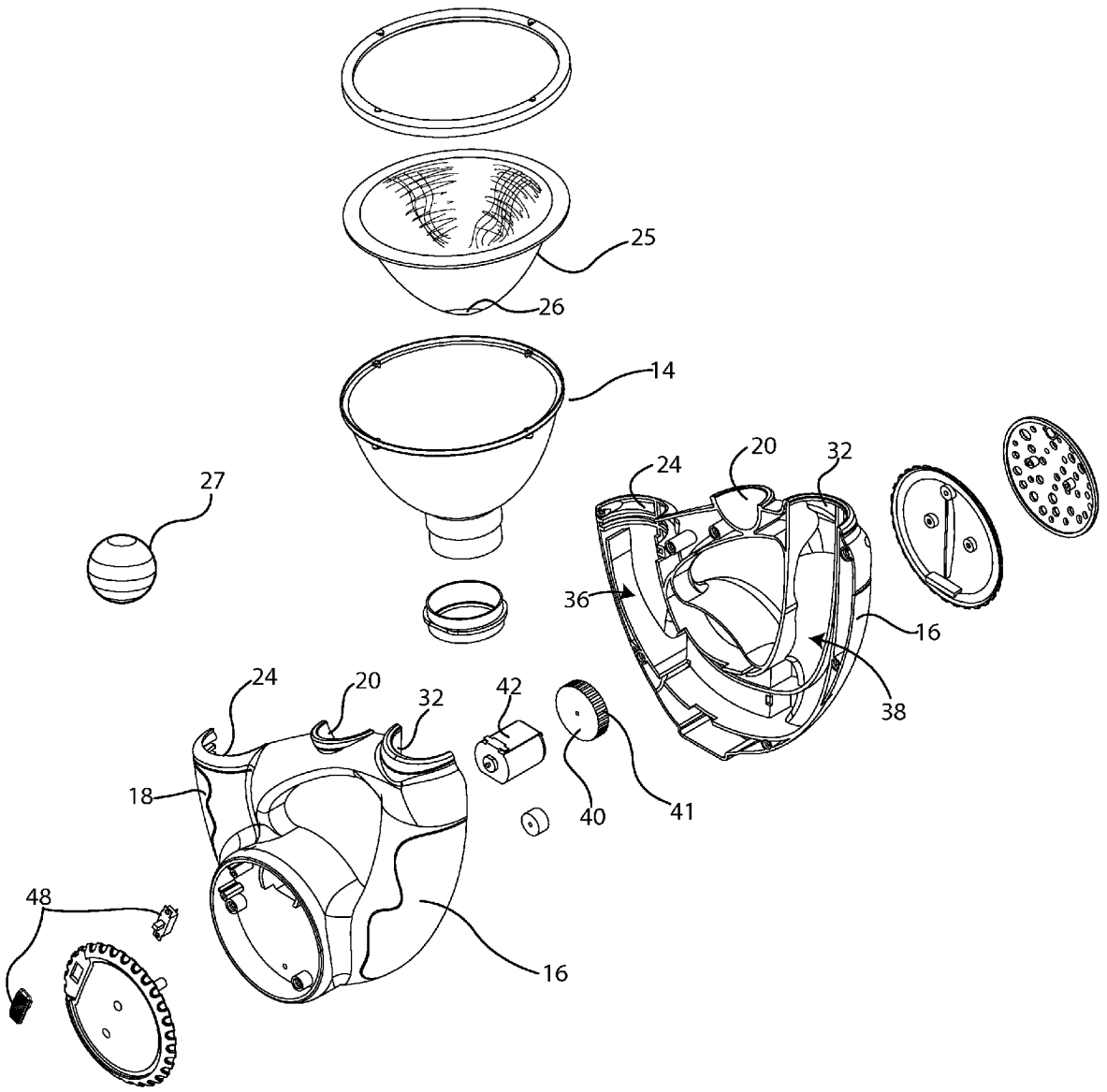
FIG. 5 is an exploded, perspective view, of the device from FIG. 1.

Now referring to FIGS. 4*a* through 5, the body 12 may define an internal system to operate with an object launch mechanism in communication therewith. For example, the internal system may include the inlet 24, an outlet 32, and a channel therebetween. The inlet 24, the outlet 32, and the channel may be defined by the body 12. The channel may include a delivery channel 36 and a launch channel 38. While the channels are shown as generally u-shaped, it is contemplated that more than one shape is available for the channel. The inlet 24 may be in communication with the receiving funnel 14 such that an object may enter the receiving funnel 14 and travel through the inlet 24 to the delivery channel 36. The launch mechanism may include a capability to generate energy to assist in launching the ball 27 through the outlet 32 and into the air.

For example, the launch mechanism may be a rotation mechanism including a wheel 40 and a motor 42 in communication with a power source (not shown). The wheel 40 may define a surface 41, be rotatably secured to the body 12, and arranged with the delivery channel 36 and the launch channel 38. The motor 42 may be in communication with the wheel 40 and in communication with a switch 48 which may direct operation of the motor 42 including motor speed. For example, it may be desirable to provide more than one speed level for the motor 42 such that users may launch the ball 27 into the air at different heights for different user skill levels. The switch 48 may include a low, medium, and/or high setting which may correspond to different motor 42 speeds.

The device 10 may also include a printed circuit board (not shown) having one or more integrated circuits (not shown) which may direct operations of the device 10 according to software instructions stored on the integrated circuit. As an alternative to the wheel 40, the motor 42 may be in communication with a spring and lever (not shown) such that the spring may be energized and release the energy to move the lever to launch the ball 27. Other suitable mechanical mechanisms for applying force to the ball sufficient to expel the ball from the device are also contemplated, such as, but not limited to, forced air, a pin striking the ball, etc.

The surface 41 may have ridges to assist in directing movement of the ball 27 at contact as further shown in FIGS. 4*b* and 4*c*. Another example of a suitable shape for the surface 41 may be similar to that of a spool. The surface 41 of the wheel 40 may be oriented with the delivery channel 36 and the launch channel 38 such that the wheel 40 may adjust a first speed of the ball 27 traveling through the delivery channel 36 and send the object into the launch channel 38 at a second speed. For example, the user may trigger the switch 48 to select one of the speed settings such as low, medium or high. Selecting the speed setting may send a control signal to the motor 42 to operate at an according speed, which in turn drives rotation of the wheel 40. The ball 27 may enter the delivery channel 36 via the inlet 24 and may be traveling at the first speed. The ball 27 may contact the wheel 40 as the wheel 40 is rotating such that the ball 27 enters the launch channel 38 at the second speed to exit the outlet 32 and launch into the air.

In addition to launching and/or tossing the ball 27 into the air, the user may also position the device 10 to catch the ball 27 within the receiving funnel 14. For example, as the ball 27 begins to descend following launch through the outlet 32, the user may move the device 10 to orient the receiving funnel 14 below the ball 27. If executed properly, the user may "catch" the ball 27 within the receiving funnel 14 such that the ball 27 travels to the delivery channel 36 via the through-hole 26 and the inlet 24. A user may also place the device 10 on a surface, such as a floor, and toss the ball 27 toward the device 10 in an attempt to land the ball 27 in the receiving funnel 14. The device 10 may then launch the ball 27 back to the user. As such, multiple game play patterns may be available for use with the device 10.

Figure 6:
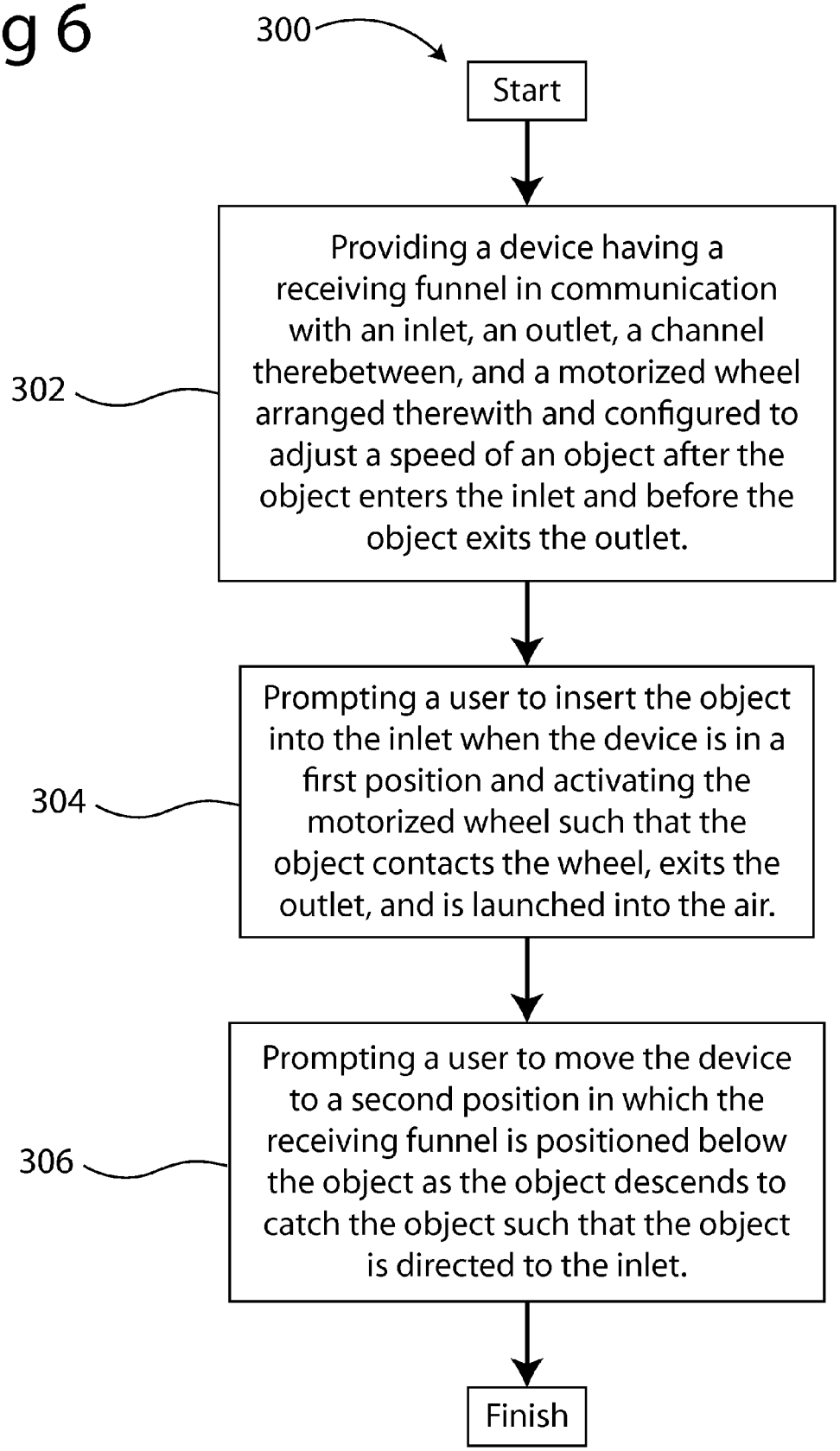
FIG. 6 is a flow chart showing steps of a method of game play to launch and catch an object using a device according to one embodiment.

Now referring to FIG. 6, a method of game play is generally indicated by reference numeral 300. Operation 302 may include providing a device having a receiving funnel in communication with an inlet and an outlet, a channel therebetween, and a motorized wheel arranged therewith. The motorized wheel may be configured to adjust a speed of an object, such as a ball, after the object enters the inlet and before the object exits the outlet. For example, the device 10 as described above may be utilized with the method of game play 300. In operation 304, the user may be prompted to begin play by inserting the object into the inlet when the device is in a first position. The user may also be prompted to activate the motorized wheel, such as by triggering a switch in communication therewith, following insertion of the object into the inlet or prior to. The object may be traveling at a first speed toward the now rotating motorized wheel. When the object contacts the motorized wheel, the motorized wheel may adjust the traveling speed of the object to a second speed enroute to the outlet. For example, the second speed may be greater than the first speed to assist in launching the object into the air once the object exits the outlet. In operation 306, the user may be prompted to move the device from the first position to a second position. The receiving funnel may be positioned below the object in the second position as the object descends to attempt to catch the object within the receiving funnel such that the object is directed to the inlet to launch again. As such, the user may launch and catch the object to, for example, juggle the objects.

Figure 7:
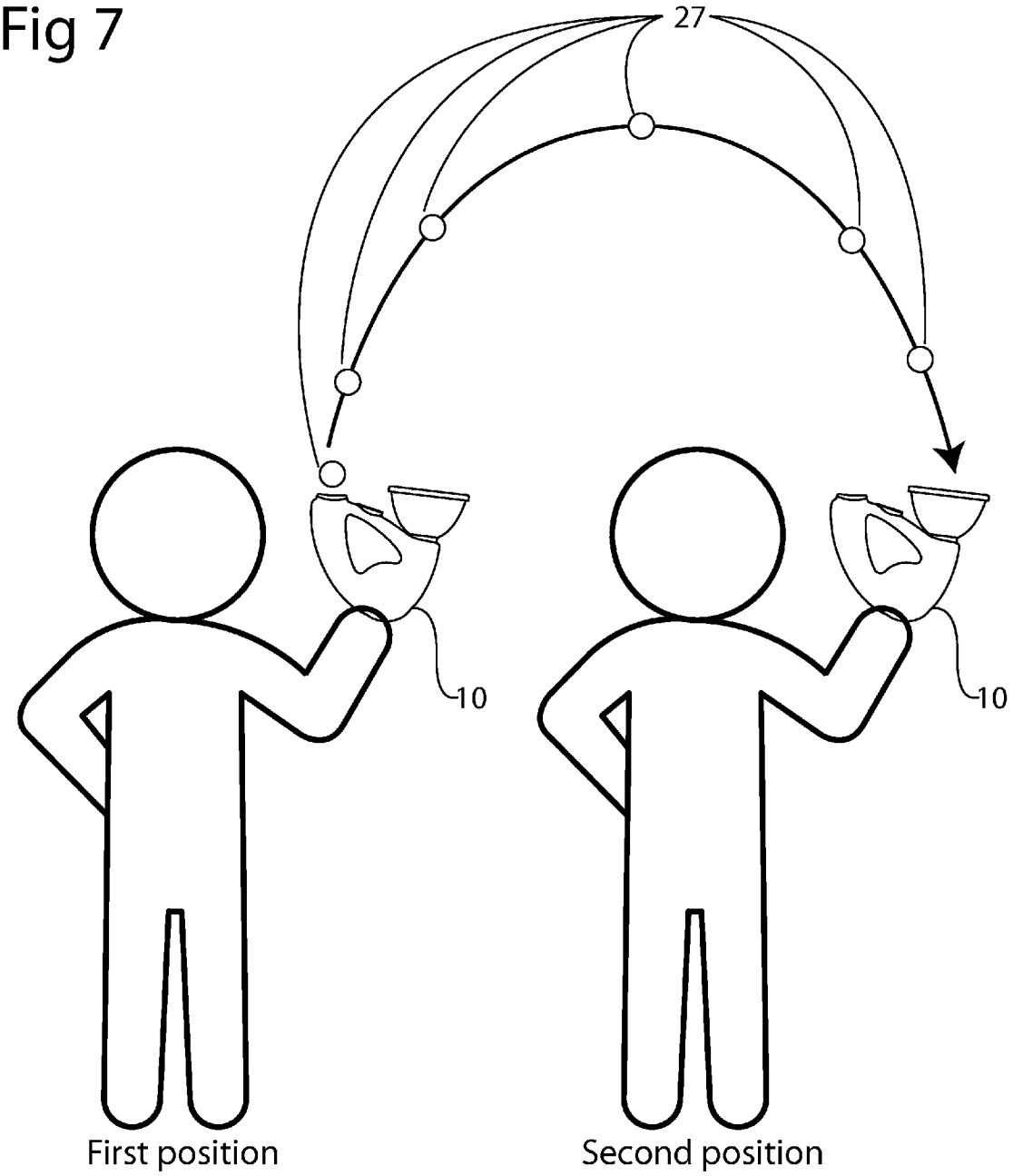
FIG. 7 is an illustrative view of a first and second position for the device when used with the method of game play from FIG. 6.

FIG. 7 shows an illustrative example of the first position and second position from the method of game play 300 in which the user launches the object, follows the flight of the object, and moves the device to catch the object within the receiving funnel. Additionally, two or more devices may be provided to an according number of players such that the users may launch and catch the object between one another.

While exemplary embodiments are described above, it is not intended that these embodiments describe all possible forms encompassed by the disclosure. The words used in the specification are words of description rather than limitation, and it is understood that various changes can be made without departing from the spirit and scope of the disclosure. As previously described, the features of various embodiments can be combined to form further embodiments of the disclosure that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A toy device comprising:

a handheld body defining a handle sized for a user to grasp, an inlet, an outlet, and a channel therebetween;

a funnel secured to the body and open to the inlet;

a damper disposed within the funnel and sized to mirror a shape of the funnel to dampen an impact of an object received therein; and an actuator assembly with a motorized output gear at least partially disposed within the channel to propel an object through the outlet, wherein the handle is arranged with the funnel for handheld operation of the toy device by the user.

2. The device of claim 1, wherein the damper comprises a continuous sheet of material disposed and extending downward within the funnel along a curved portion thereof and defines a through hole in at least partial registration with the inlet.

3. The device of claim 1, further comprising a switch, wherein the actuator assembly further comprises a motor operably connected to the output gear, and wherein the switch triggers activation of the motor at one or more predetermined speeds to adjust a height at which an object reaches relative to the outlet when propelled therethrough.

4. The device of claim 3, wherein the output gear defines a contact surface along a circumference of the output gear with traction.

5. The device of claim 3, further comprising a power source supported by the body to power the motor.

6. The device of claim 1, wherein the channel is generally arcuate and the outlet is spaced apart from the actuator assembly a first distance and the inlet is spaced apart from the actuator assembly a second distance that is less than the first distance.

7. A launch and catch device comprising:

a handheld body defining a handle sized for a user to grasp for handheld operation of the launch and catch device, an inlet, an outlet, and a channel therebetween;

a funnel secured to the body and defining an inner surface open to the inlet;

a flexible member disposed and extending within the funnel and at least partially spaced from a funnel curved surface, defining a circular through hole in at least partial registration with the inlet, and sized to mirror a shape of the funnel, a switch mounted to the body;

a motor mounted within the body;

a controller in electrical communication with the switch and the motor such that actuation of the switch activates the motor to operate at a predetermined speed; and a wheel operably connected to the motor and at least partially disposed within the channel to increase a speed of an object traveling from the inlet to the outlet.

8. The device of claim 7, wherein the flexible member includes ornamental indicia indicative of a target.

9. The device of claim 7, wherein the flexible member comprises a fabric having characteristics which yield to an impact thereon.

10. The device of claim 7, wherein the body further defines a retaining well sized to at least partially retain an object therein.

11. A launch and catch device comprising:

a handheld body defining a handle sized for a user to grasp during operation of the launch and catch device, an inlet, an outlet, and a channel therebetween;

a funnel secured to the body and defining an inner surface and open to the inlet;

a sheet of material disposed and partially extending within the funnel, at least partially spaced apart from the inner surface, sized to mirror a shape of the funnel, and defining a through hole open to the inlet;

a motor secured to the body; and a wheel operably connected to the motor and arranged with the channel to propel an object through the outlet.

* * * * *